US005767613A

United States Patent [19]

Kunt

[11] Patent Number: 5,767,613

[45] Date of Patent: Jun. 16, 1998

[54] SPARK PLUG WITH ENLARGED CENTER ELECTRODE AND GAP

[75] Inventor: Erhan Kunt, Dededo, Guam

[73] Assignee: Bisnes Mauleg, Inc., Dededo, Guam

[21] Appl. No.: 677,508

[22] Filed: Jul. 9, 1996

Related U.S. Application Data

[63] Continuation-in-part of Ser. No. 655,519, Jun. 17, 1996, abandoned.

[51] Int. Cl.[6] ..... H01T 13/20

[52] U.S. Cl. ..... 313/141; 313/133; 313/139

[58] Field of Search ..... 313/133, 139, 313/141

[56] References Cited

U.S. PATENT DOCUMENTS

| | | | |
|---|---|---|---|
| 1,989,670 | 2/1935 | Anthony | 313/139 |
| 3,706,897 | 12/1972 | Shepardson | 313/139 |
| 4,695,758 | 9/1987 | Nishida et al. | 313/130 |
| 5,196,760 | 3/1993 | Takamura et al. | 313/141 |
| 5,493,171 | 2/1996 | Wood et al. | 313/141 |

*Primary Examiner*—Sandra L. O'Shea
*Assistant Examiner*—Vip Patel
*Attorney, Agent, or Firm*—Seed and Berry LLP

[57] ABSTRACT

A spark plug for an internal combustion engine that burns fuel from a fuel source, the engine including a block assembly with a piston cylinder, a fluid combustion chamber connected to the piston cylinder, and an air and fuel mixing area that communicates with the combustion chamber for delivering an air and fuel mixture to the combustion chamber. A fuel delivery system is connected to the block assembly, and the fuel delivery system has a fuel passage that communicates with the fuel mixing area. The fuel delivery system has a delivery nozzle connected to the fuel passage and being directed toward the fuel mixing area, and the delivery nozzle is sized to spray a selected amount of fuel into the mixing area for mixing with air therein to provide an air and fuel mixture having an air-to-fuel ratio in the range of 90:1 to 240:1. A fuel line is connected to the fuel source and the fuel delivery system to carry the fuel from the fuel tank to the fuel delivery system. A spark plug is connected to the block assembly and positioned to generate a spark in the combustion chamber to ignite the air and fuel mixture. The spark plug has a center electrode and a ground electrode spaced apart from each other by a spark gap in the range of 1.5 mm to 2.O mm. The center electrode is a platinum electrode having a diameter in the range of 4.5 mm to 7.5 mm.

1 Claim, 6 Drawing Sheets

SPARK PLUG WITH ENLARGED CENTER ELECTRODE AND GAP

CROSS-REFERENCE TO RELATED APPLICATION this application is a continuation-in-part application from U.S. patent application Ser. No. 08/655,517, filed Jun. 17, 1996 now pending.

TECHNICAL FIELD

The invention relates to devices used in an internal combustion engine, for efficient combustion of fuel to provide improved fuel efficiency and substantially reduced emissions from the engine.

BACKGROUND OF THE INVENTION

In a conventional gasoline powered internal combustion engine having a fuel injection system or a carburetor, the engine receives gasoline from a conventional fuel line, the gasoline is channeled through a fuel injector or the carburetor, and the gasoline is mixed with air and delivered into the combustion chamber. The gasoline is then ignited in the combustion chamber by a spark plug.

In a conventional fuel injection system, an injection nozzle is disposed in an intake manifold near the combustion chamber. The gasoline from the fuel line is discharged in a spray from the injection nozzle toward the combustion chamber. Ejection of the gasoline from the injection nozzle to a relatively large empty space reduces the gasoline to a spray. The spray of gasoline is mixed with air in an air-to-fuel ratio of approximately 15:1. The air and fuel mixture is then passed into the combustion chamber of cylinders in the engine for ignition by the spark plugs.

A conventional spark plug, which generates a relatively small spark, explosively ignites the air and fuel mixture in the combustion chamber. Upon the injection nozzle breaking up the gasoline into the spray as mentioned above, the contact area or mixture of the gasoline spray with oxygen of air is increased, so the gasoline is explosively burned. However, the amount of fuel and air in the mixture and the spark for igniting the fuel must be carefully controlled to avoid the engine from running too rich (e.g., too much fuel) or too lean (e.g., not enough fuel) for the selected configuration of the engine. The conventional fuel injector and carburetor in combination with a conventional spark plug require a substantial amount of fuel to be sprayed toward the combination chamber, such that the gasoline in the spray is not all burned upon generation of the spark by the spark plug. As a result, the conventional internal combustion engine has a limited fuel efficiency, and the engine undesirably discharges unburned liquid gasoline and other emissions, such as carbon monoxide, carbon dioxide, hydrocarbons, or nitrogen oxides, into the environment.

SUMMARY OF THE INVENTION

The present invention provides a combination of a fuel restrictor and a spark generating device in an internal combustion engine that overcomes the drawbacks experienced by conventional internal combustion engines. In a preferred embodiment of the invention, a fuel flow reducing member is attached to an internal combustion engine such that very fine atomization of the fuel is provided, and the atomized fuel is mixed with air in an air-to-fuel ratio of 90:1 to 240:1. A spark plug having an enlarged center electrode spaced apart from a ground electrode is provided adjacent to the combustion chamber for ignition of the air and fuel mixture. The spark plug generates a large spark in the combustion chamber for substantially complete combustion of the air and fuel mixture in the combustion chamber, thereby increasing fuel combustion efficiency and decreasing engine emissions without a reduction in power output by the engine.

In the preferred embodiment, a fuel flow restricting device is positioned in a fuel hose adjacent to an inlet tube of a fuel injector or a carburetor for delivering a reduced flow of fuel through the injector or carburetor, and the reduced flow of fuel is finely atomized, mixed with air, and delivered into the combustion chamber. The fuel flow restricting device has a nozzle portion through which the fuel is passed, finely atomized, and then passed toward the combustion chamber. As the fuel passes through the nozzle portion of the fuel flow restricting device, the fuel is reduced to a spray and it is further finely atomized by the fuel injector or carburetor, thereby resulting in an almost gaseous fuel that is mixed with air. The gaseous fuel is mixed with much more oxygen, and the air-fuel mixture ignited by the spark plug is burned with substantially complete combustion in the combustion chamber.

The spark plug generates an enlarged spark at the combustion chamber in order to efficiently and explosively burn the air-fuel mixture in the combustion chamber. As a result, the internal combustion engine with the fuel supplying assembly of the present invention burns a significantly reduced amount of fuel without a reduction in power output from the engine. The substantially complete combustion of the reduced amount of fuel results in a minimum amount of emissions from the engine.

DETAILED DESCRIPTION OF THE INVENTION

The embodiments of the fuel restrictor and spark plug combination in an internal combustion engine in accordance with the present invention are hereinafter described with reference to the appended drawings.

Figure 1:
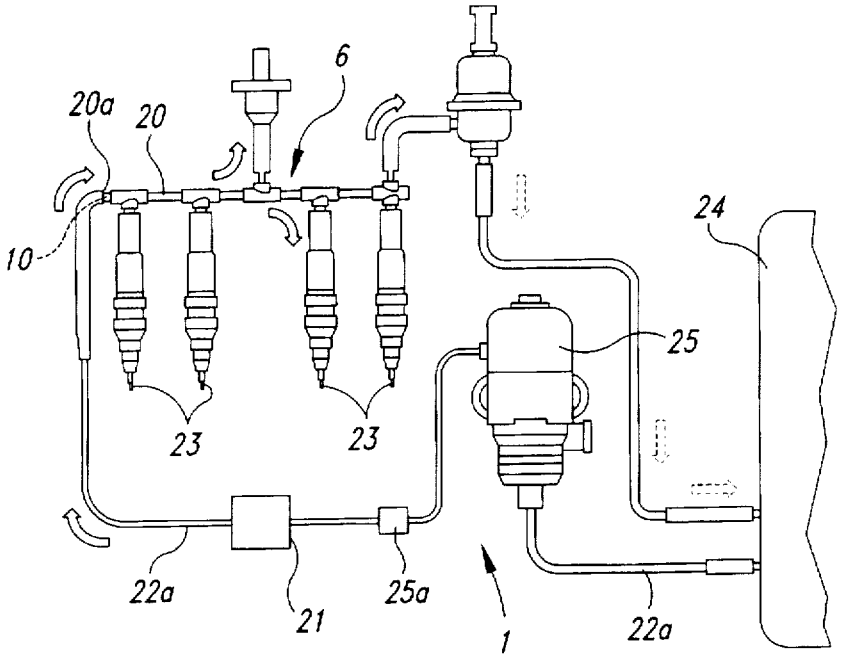
FIG. 1 is a schematic view of a fuel delivery system of an internal combustion engine showing a fuel hose with a fuel flow restricting device in accordance with the present invention therein adjacent to a fuel injector system.

Referring now to FIG. 1, a fuel delivery system 1 of an internal combustion engine 5 is illustrated having a fuel injection system 6 that includes a plurality of fuel injectors 23 connected to a generally rigid fuel tube 20. The fuel tube 20 has an inlet end 20*a* connected to a flexible fuel hose 22, and the fuel hose is operatively connected to a fuel line 22*a* that is, in turn, connected to a fuel tank 24. The fuel line 22*a*, fuel hose 22, and the fuel tube 20 carry gasoline from the fuel tank 24 to the fuel injectors 23. The fuel line 22*a* includes a fuel pump 25 that pumps the gasoline from the fuel tank 24 toward the fuel injectors 23, and a fuel silencer 25*a* that reduces pulsation of the fuel pumped by the fuel pump. A fuel filter 2l is connected to the fuel line 22*a* for filtering the gasoline as it flows through the fuel line to remove any impurities before the gas reaches the fuel injection system 6.

The fuel hose 22 is a conventional fuel hose having an inner diameter of approximately 8 mm. A fuel flow restricting device 10 in accordance with the present invention is positioned in the fuel hose 22 adjacent to the inlet end 20*a* of the fuel tube 20 such that the gasoline must pass through the fuel flow restricting device before entering the fuel tube or the fuel injectors 23. The fuel flow restricting device 10 provides a nozzle that restricts and limits the flow of gasoline from the 8 mm fuel hose to the fuel tube 20 and the fuel injectors 23.

Figure 2A:
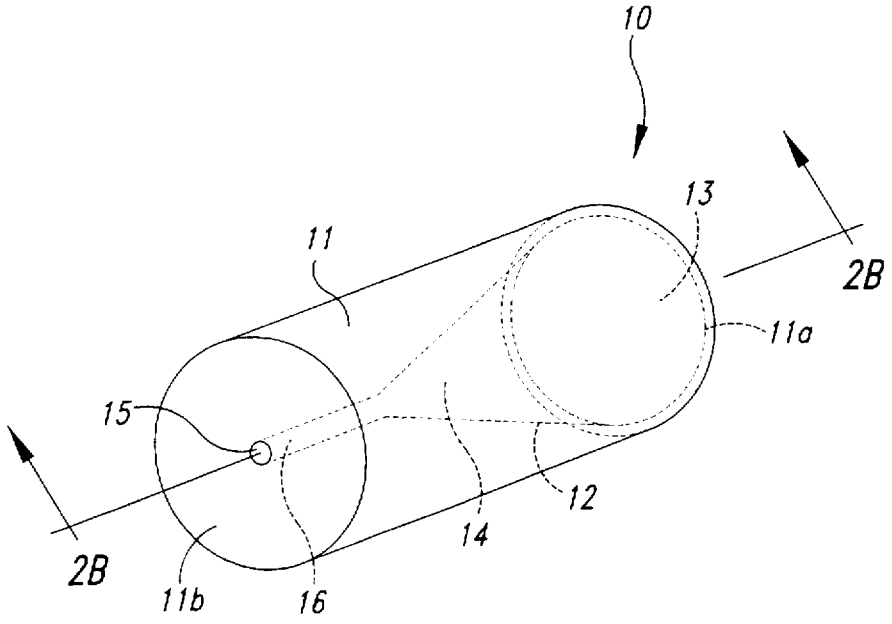
FIG. 2*a* is an enlarged perspective view of the fuel flow restricting device of FIG. 1, with an interior funnel-shaped passage shown in hidden lines.
Figure 2B:
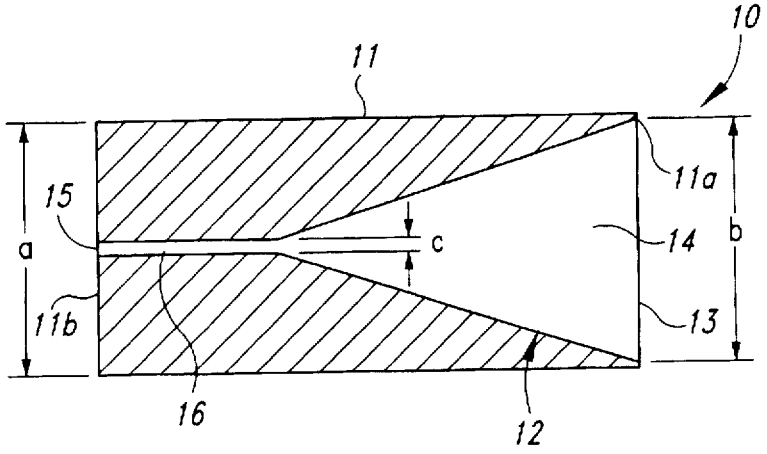
FIG. 2*b* is a cross-sectional view taken substantially along line 2*b*–2*b* of FIG. 2*a*.

As best seen in FIGS. 2*a* and 2*b*, the fuel flow restricting device 10 has a cylindrical body 11 with a fuel receiving end 11*a* and a fuel discharging end 11*b* opposite the fuel receiving end. Each of the fuel receiving and discharging ends 11*a* and 11*b* of the body 11 has an outer diameter "a" of approximately 8 mm. The longitudinal length of the body 11 is approximately 30 mm. In the preferred embodiment, the fuel flow restricting device 10 is a brass member, although other materials can be used.

A passage 12 is formed in the body 11 along a longitudinal axis of the body passing through the centers of the fuel receiving and discharging ends 11*a* and 11*b*. The passage 12 is shaped like a funnel having a conical portion 14 with a large circular opening 13 at the fuel receiving end 11*a* and a narrow tubular portion 16 that is connected to the conical portion 14. The narrow tubular portion 16 extends away from a tapered end of the conical portion 14 and terminates at a small circular opening 15 in the fuel discharging end 11*b* of the body 11. In the preferred embodiment, a diameter "b" of the large opening 13 is approximately 7.937 mm (0.3125 inches), and an inner diameter "c" of the small opening 15 is in the range of approximately 0.5 mm to 1.5 mm. The diameter "c" is also the size of the small end of the conical portion 14. Accordingly, the cross-sectional area of the fuel line 22*a* having an 8 mm internal diameter is approximately 128 times larger than the cross-sectional area of the small opening 15, if 0.5 mm in size, and approximately 7.11 times larger than the small opening if 1.5 mm in size.

The preferred diameter of the small opening 15 is dependent upon the size of the engine 5. As an example, a four cylinder engine is provided with a fuel flow restricting device 10 having a 0.5 mm diameter small opening 15. A large V-8 engine is provided with a fuel flow restricting device 10 having a 1.25 mm to 1.5 mm diameter small opening 15. Other engines have been successfully tested with the small opening 15 of the fuel flow restricting device 10 having diameters of 0.6 mm, 0.75 mm, and 1.0 mm. Accordingly, the amount of gasoline that is delivered to the fuel injection system 6 from the 8 mm fuel line is substantially restricted and limited by the fuel flow restricting device 10.

The longitudinal length of the conical portion 14 is approximately 20 mm and the longitudinal length of the narrow tubular portion 16 is approximately 10 mm, such that they are arranged in a length ratio of 2:1. In an alternate embodiment, the narrow tubular portion 16 has a length of approximately 3.175 mm (approximately 0.0625 inches) such that the conical and narrow tubular portions 14 and 16 are arranged in a length ratio of approximately 9.45:1.

Figure 3:
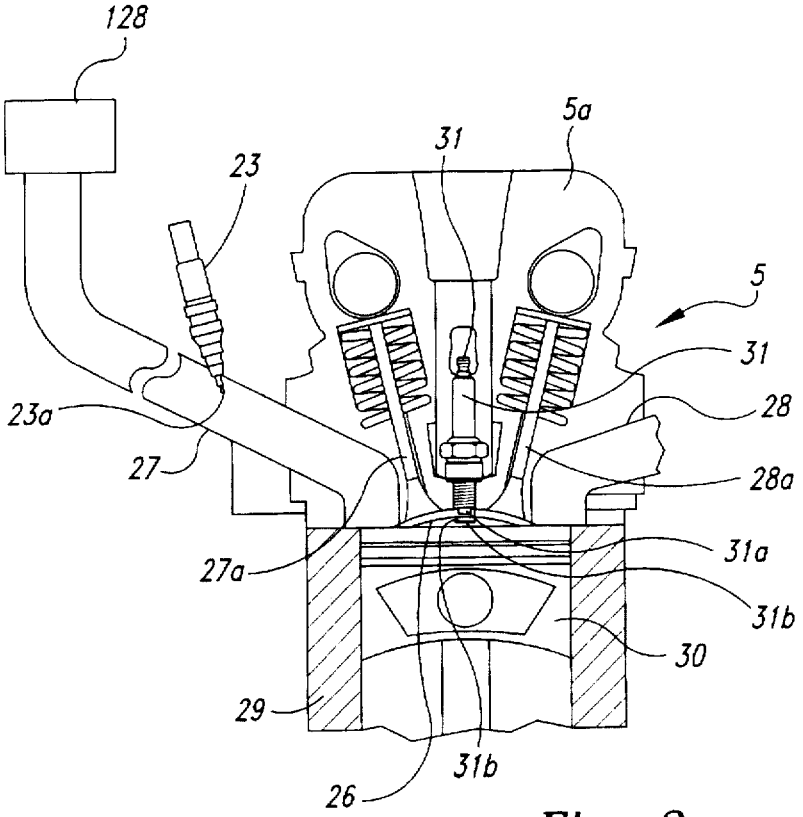
FIG. 3 is an enlarged schematic cross-sectional view of one fuel injector of FIG. 1 and an associated combustion chamber, with a spark plug of the invention shown adjacent to the combustion chamber.

The fuel flow restricting device 10 is shaped and sized to snugly and securely fit within the fuel hose 22 to form a passage through the fuel flow restricting device through which substantially all gasoline must pass before reaching a combustion chamber 26 of the engine 5 (see FIG. 3). The outer diameter "a" of the body 11 is approximately the same as the inner diameter of a fuel hose 22 (FIG. 1) to ensure the fuel flow restricting device 10 snugly fits in the fuel hose and prevents fuel from passing through the fuel hose around the exterior of the body 11. Accordingly, the fuel flow restricting device 10 discharges gasoline as a spray of atomized fuel into the fuel tube 20 toward the fuel injectors 23.

As best seen in FIG. 3, each fuel injector 23 delivers the atomized fuel to an intake manifold 27 that provides a mixing area for mixing the atomized fuel and air, and the intake manifold communicates with one of the combustion chambers 26 of the internal combustion engine 5. The fuel injector 23 has a conventional injector nozzle 23*a* that projects into the intake manifold 27. The injector nozzle 23*a* receives a portion of the atomized fuel from the fuel tube 20 provided by the fuel flow restricting device 10 and further atomizes the fuel as it passes into the intake manifold 27 to create a very finely atomized fuel. The finely atomized fuel is combined with air in the intake manifold 27, and the mixture of air and atomized fuel enters the combustion chamber 26.

Referring to FIG. 3, the reference numeral 28 denotes a conventional exhaust manifold, the reference numeral 128 denotes a conventional air filter coupled to the intake manifold, the reference numeral 27*a* denotes a conventional intake valve, and the reference numeral 28*a* denotes a conventional exhaust valve. The reference numeral 5*a* denotes a conventional engine block, the reference numeral 29 denotes a conventional piston cylinder in the engine block below the combustion chamber 26, the reference numeral 30 denotes a conventional piston within the piston cylinder, and the reference numeral 31 denotes a spark plug in accordance with the present invention at the top of the combustion chamber. Accordingly, a portion of the gasoline or other liquid fuel supplied from the fuel tank 24 through the fuel hose 22 and the fuel tube 20 (FIG. 1) is passed through the fuel flow restricting device 10 and the fuel injector 23, and exits the nozzle 23*a* of the fuel injector such that the atomized fuel is combined with air in the mixing area in a selected air-to-fuel ratio. The air and fuel mixture is passed into the combustion chamber 28 for compression by the piston 30 and ignition by the spark plug 31.

Figure 4:
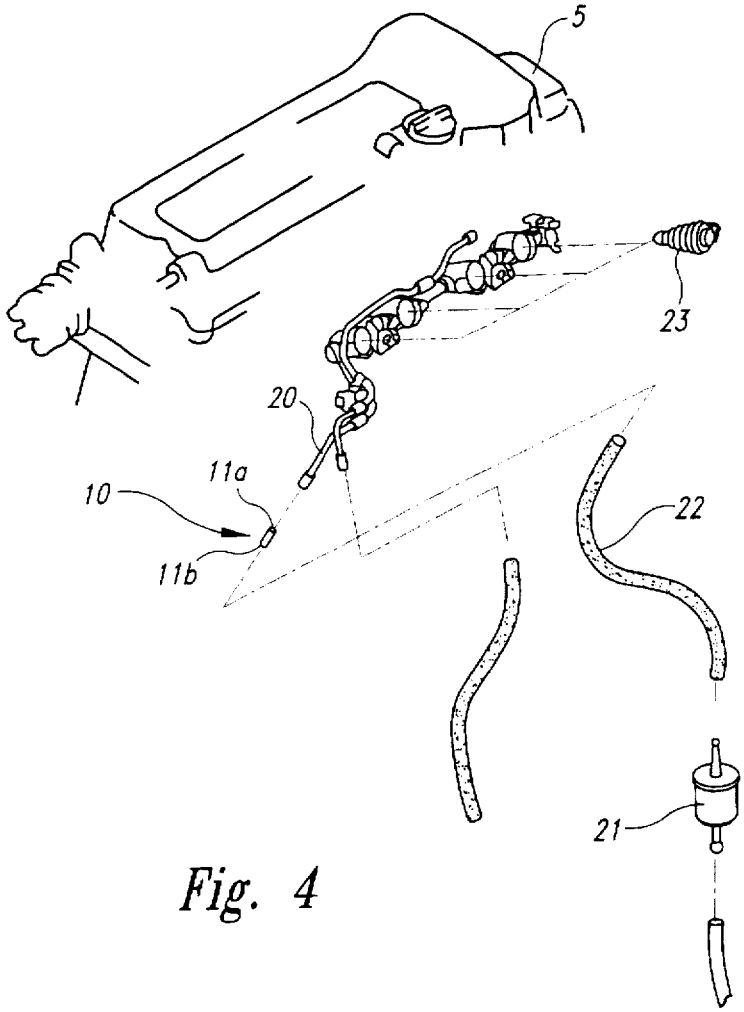
FIG. 4 is an exploded schematic view of the fuel delivery system of FIG. 1 showing devices for delivering fuel.
Figure 5:
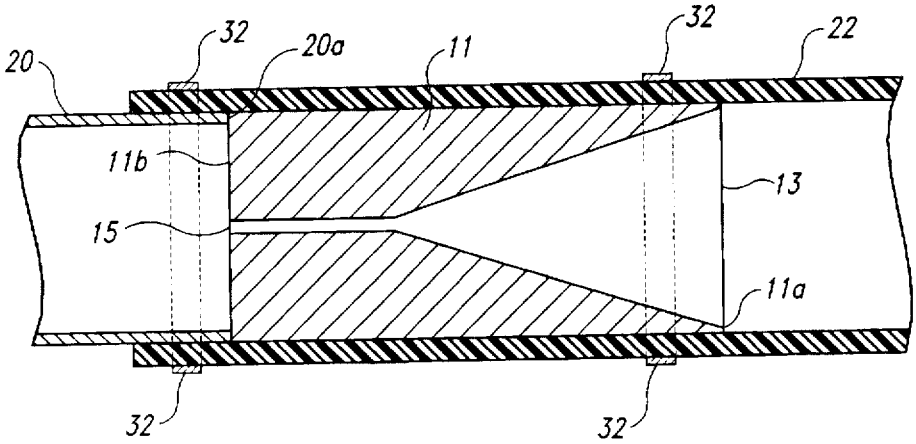
FIG. 5 is an enlarged sectional view showing the fuel flow restricting device of FIG. 1 positioned in the fuel hose.

As best seen in FIGS. 4 and 5, the fuel flow restricting device 10 is securely fit into the end portion of the fuel hose 22, and the fuel hose is connected to the inlet end 20*a* of the fuel tube 20. The fuel discharging end 11*b* of the device's body 11 faces toward the end 20*a* of the fuel tube 20 and the fuel receiving end 11*a* of the body faces away from inlet end of the fuel tube. As best seen in FIG. 5, the fuel flow restricting device 10 fits in the fuel hose 22 and is secured in place by a hose clamp 32. The fuel hose 22 is tightly fastened to the inlet end 20*a* of the fuel tube 20 with a hose clamp 32 or other suitable fastening device. The fuel flow restricting device 10 receives fuel from the fuel hose 22 through the large opening 13 (FIG. 5) in the fuel receiving end 11*a* of the body 11, and the fuel is channeled through the narrow tubular portion 16. The fuel is discharged into the fuel tube 20 through the small circular opening 15 in the fuel discharging end 11*b* of the body 11. Accordingly, the fuel flow restricting device 10 is on an up-stream or upper-flow side of the fuel injectors 23, so the fuel injectors are between the restricting device and combustion chamber 26 to which the fuel injectors supply fuel.

The fuel flow restricting device 10 of the preferred embodiment is sized to be installed into a conventional fuel hose of existing internal combustion engines 5 in a retrofit procedure, or during the manufacturing and assembly process of the engine. The fuel flow restricting device 10 is preferably inserted into the fuel hose 22 at a location as close as possible to the inlet end 20*a* of the fuel tube 20. In the preferred embodiment, the fuel flow restricting device 10 is inserted into the fuel hose 22 immediately adjacent to the inlet end 20*a* of the fuel tube 20. However, acceptable performance can be achieved if the fuel flow restricting device 10 is positioned within approximately 6 cm of the inlet end 20*a* of the fuel tube 20.

During operation, the fuel flow restricting device 10 provides a reduced fuel flow to the fuel injector system, and the reduced fuel flow is further divided and directed to each of the fuel injectors 23 of the engine 5. In a four cylinder engine, the reduced fuel flow is divided between the four fuel injectors. As a result, a substantially smaller amount of gasoline is delivered to the combustion chamber 26 at each cylinder 29 (FIG. 3). The reduced amount of fuel is injected into the intake manifold 27 as a finely atomized spray, and air in the intake manifold, which has passed through the air filter 128, is mixed with the finely atomized fuel in an air-to-fuel ratio in the range of approximately 90:1 to 240:1. Accordingly, the internal combustion engine of the present invention utilizes a significantly higher air-to-fuel ratio than occurs in a conventional internal combustion engine which utilizes an air-to-fuel ratio of approximately 15:1. As discussed in greater detail below, the air and fuel mixture is substantially completely ignited by a spark generated by the improved spark plug 31 in accordance with the present invention.

Although the embodiment described above reduces the fuel flow with the fuel flow restricting device 10 positioned in the fuel hose 22, a similar fuel flow restriction can be provided so as to cause the fine fuel atomization by modifying the injection nozzles 23*a* of the fuel injection system 6. In an alternate embodiment of the present invention, each of the injector nozzles 23*a* is modified to provide a very small nozzle opening, e.g. a diameter in the range of approximately 0.125 mm to 0.1875 mm, to significantly limit the fuel sprayed into the intake manifold and the combustion chamber so that the atomized fuel is mixed with the air in a selected air-to-fuel ratio in the range from approximately 90:1 to 240:1. In this alternate embodiment, however, the opening in each injector nozzle 23*a* is so small, that it is susceptible to clogging if the fuel is not sufficiently filtered.

Figure 6:
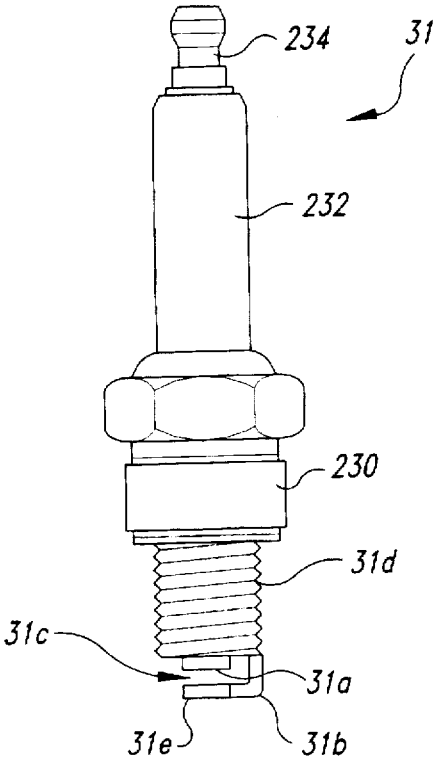
FIG. 6 is an enlarged side elevation of the spark plug of FIG. 3.
Figure 7:
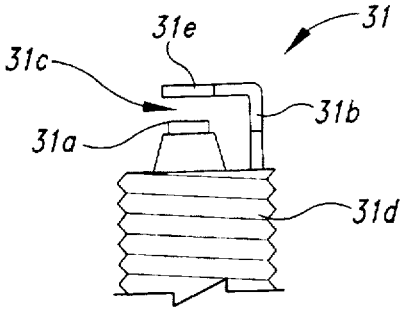
FIG. 7 is an enlarged side elevation view of a center electrode and a ground electrode of the spark plug of FIG. 6.

As best seen in FIGS. 6 and 7, the spark plug 31 used by the present invention has a metal shell 230 having a threaded lower body 31*d* extending from its lower end, and a porcelain insulator 232 is attached to an upper portion of the shell. A top terminal 234 extends upwardly from the porcelain insulator 232. The top terminal 234 is connected to a center electrode 31*a* that extends downwardly through the porcelain insulator 232, the metal shell 230, and the threaded lower body 31*d*. The center electrode 31*a* is spaced apart from a ground electrode 31*b* by an electric discharge gap 31*c*, also referred to as a spark gap.

The center electrode 31*a* is a cylindrical conductive member having a diameter in the range of approximately 4.5 mm to 7.5 mm. A center electrode of a conventional spark plug , such as the ACCEL-416 spark plug and the NGK-BCPR5ES spark plug, has a diameter of approximately 2.3 mm. Accordingly, the diameter of the center electrode 31*a* of the spark plug 31 of the present invention is approximately 1.96 to 3.26 times greater than a conventional spark plug's center electrode. Further, the cross sectional area of the center electrode 31*a* is approximately 15.896 $mm^2$ to 44.156 $mm^2$, which is approximately 3.825 to 10.627 times greater than the 4.155 $mm^2$ cross sectional area of a conventional spark plug's center electrode. The spark plug 31 of the preferred embodiment includes a platinum center electrode 31*a* having a diameter in the range of approximately 4.5 mm to 5.5 mm. In an alternate embodiment, the center electrode 31*a* is a cylindrical steel member having a diameter of approximately 7.0 mm to 7.5 mm.

The ground electrode 31*b* is L-shaped and is connected at one end to a threaded plug body 31*d*, and has its opposite free end portion 31*e* spaced apart from the center electrode 31*a* by the spark gap 31*c*. The free end portion 31*e* of the ground electrode 31*b* has a diameter or width in the range of 4.5 mm to 7.5 mm. The width of a free end of a conventional ground electrode is approximately 3 mm. The diameter of the free end portion 31*e* in the preferred embodiment substantially corresponds to the diameter of the center electrode 31*a*. The size of the spark gap 31*c* is in the range of approximately 1.5 mm to 2.0 mm. In the preferred embodiment, a spark plug 31 having a platinum center electrode 31*a* with a diameter of approximately 4.5 mm is used in a four-cylinder internal combustion engine, and the fuel flow restricting device 10 in the fuel hose 22 has a small opening with a diameter of approximately 0.5 mm. A spark plug 31 having a platinum center electrode 31*c* with a diameter of approximately 5.5 mm is used in an eight-cylinder internal combustion engine, and the fuel flow restricting device 10 in the fuel hose 22 has a small opening of approximately 1.25 mm.

As best seen in FIG. 3, the spark plug 31 is positioned with the enlarged center electrode 31*a* and the ground electrode 31*b* at the top of the combustion chamber 26. The spark plug 31 produces a spark that arcs across the spark gap 31*c* to explosively ignite the mixture of finely vaporized gasoline and air, thereby driving the piston 30 in the piston cylinder 29 on the down stroke. The spark generated by the spark plug 31 between the enlarged center electrode 31*a* and the enlarged free end portion 31*e* of the ground electrode 31*b* has a volume approximately 15 to 22 times larger than a spark produced by a conventional spark plug. Accordingly, the contact area of the enlarged spark with the air-fuel mixture is increased substantially, providing for quick ignition of the air and fuel mixture.

The enlarged spark provides for substantially complete and efficient combustion and combustion spread, such that approximately 100% of the atomized fuel in the combustion chamber is explosively ignited. The quick and nearly complete burn of the reduced amount of fuel in the combustion chamber results in greatly increased fuel efficiency over that of a conventional internal combustion engine. The quick, explosive combustion of the air and fuel mixture drives the piston in the cylinder on the down stroke with sufficient force such that there is no loss of power generated by the engine as a result of using the reduced amount of fuel. In addition, the quick and complete burn of the reduced amount of fuel allows the engine to operate at lower temperatures generated in the cylinders, such that the engine of the present invention runs cooler than a conventional internal combustion engine.

Figure 8:
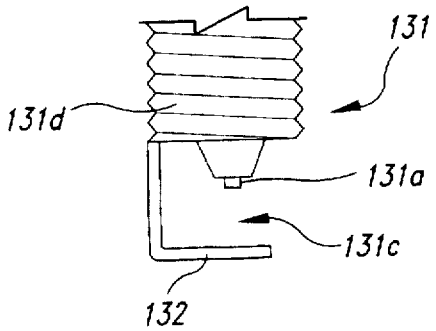
FIG. 8 is an enlarged side elevation view of a center electrode and a ground electrode of an alternate embodiment of the spark plug of FIG. 6.

As best seen in FIG. 8, a spark plug 131 of an alternate embodiment of the present invention has a center electrode 131*a* with a diameter of approximately 2.3 mm, which is the size of a conventional center electrode. The spark plug 131 has an elongated L-shaped ground electrode 131*b* extending away from a threaded plug body 131*d*, and a free end portion 132 of the ground electrode is spaced apart from the center electrode 131 a by an enlarged spark gap 131*c*. The enlarged spark gap 131*c* has a width of approximately 1.6 mm to 2.5 mm, which is approximately two to three times as large as the spark gap of a conventional spark plug. The center electrode 131*a* and the ground electrode 131*b* are sized and spaced to generate a longer spark having a greater volume and contact area for quick and complete ignition of the reduced amount of fuel in the air and fuel mixture within the combustion chamber. The longer spark results in approximately 100% burn of the atomized fuel in the engine's combustion chamber 29 to generate a driving force that drives the piston on the down stroke without a loss of power generated by the engine.

Figure 11:
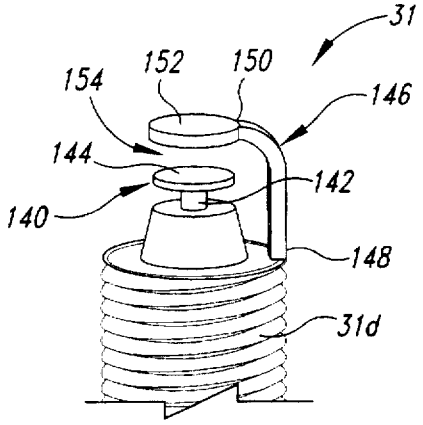
FIG. 11 is an enlarged isometric view of a center electrode and a ground electrode of an alternate embodiment of the spark plug of FIG. 6.

As best seen in FIG. 11, another alternate embodiment of the spark plug 31 has a center electrode 140 with a shaft 142 extending outwardly from the threaded plug body 31*d*, and an enlarged end or top member 144 is attached to the top of the shaft. The enlarged top member 144 has a cross-sectional area that is greater than the cross-sectional area of the shaft 142. The center electrode 140 of the illustrated alternate embodiment is platinum and the top member 144 is integrally connected to the shaft 142.

The shaft 142 of the center electrode 140 is a cylindrical member having a diameter of approximately 2.3 mm. The disc-shaped top member 144 is coaxially aligned with the shaft 142, and the top member has a diameter in the range from approximately 4.5 mm to 7.5 mm. Accordingly, the cross-sectional area of the top member 144 is approximately 3.825 to 10.627 times greater than the cross-sectional area of the shaft 142.

A generally L-shaped ground electrode 146 is attached at one end 148 to the threaded plug body 31*d*, and a free end 150 of the ground electrode is spaced apart from the center electrode 140. The free end 150 has an enlarged disc-shaped end member 152 thereon spaced apart from the disc-shaped top member 144 of the center electrode 140 by a spark plug gap 154. Accordingly, the cross-sectional area of the one end 148 of the ground electrode 146 is smaller than the cross-sectional area of the disc-shaped end member 152.

The disc-shaped end member 152 of the ground electrode 146 preferably has a diameter in the range from approximately 4.5 mm to 7.5 mm, and the spark plug gap 154 is in the range from approximately 1.5 mm to 2.0 mm. Although this alternate embodiment has a platinum center electrode 140 with a disc-shaped top member 144 and has a ground electrode 146 with a disc-shaped end member 152, the top member and the end member can have other enlarged shapes that provide increased surface areas to generate an enlarged spark between the center and ground electrodes across the spark plug gap.

The operation of the fuel flow restricting device 10 and internal combustion engine 5 provided with the device arranged as discussed above will now be described. Referring to FIG. 1, gasoline contained in the fuel tank 24 is first drawn from the fuel tank into the fuel line 22*a*, and pumped through the fuel line by the fuel pump 25. The gasoline is passed through a silencer 25*a*, which lessens the pulsation of the gasoline caused by the fuel pump 25. The gasoline next passes through the fuel filter 21 for filtering to eliminate impurities from the gasoline. The gasoline is then pumped along the fuel line 22*a*, into the 8 mm diameter fuel hose 22, and through the fuel flow restricting device 10 adjacent to the inlet end 20*a* of the fuel tube 20, whereby the volume of gasoline flow is substantially reduced as compared to the gasoline flow into a fuel injection of a conventional engine.

When the liquid gasoline is passed through the fuel flow restricting device 10 of the preferred embodiment, the gasoline is sprayed from the small circular opening 15 of the fuel flow restricting device into the fuel tube 20 at its inlet end 20*a*. The spray of gasoline is sent toward the injectors 23 through the fuel tube 20. The reduced flow of gasoline is delivered to and further divided among the fuel injectors 23.

The gasoline passing through each of the injectors 23 is further atomized and discharged through the injection nozzle 23*a* into the intake manifold 27 toward a corresponding one of the combustion chambers 26, as shown in FIG. 3. In the preferred embodiment, the finely atomized, virtually gaseous fuel is mixed with the air in the intake manifold 27 with an air-to-fuel ratio of approximately 150:1, and the air and fuel mixture enters the combustion chamber 26 for compression by the piston 30. The spark plug 31 generates the enlarged spark at a selected time, and the enlarged spark ignites the compressed mixture to explosively and completely burn the fuel in the combustion chamber 26.

Below are the results of measurements of fuel consumption ratios and exhaust gases obtained during a running test of an automobile having a gasoline-powered internal combustion engine that includes the fuel flow restricting device 10 and the spark plugs 31 as described above. For measurement of the fuel consumption ratios, consumed fuel was determined by completely filling the fuel tank with gasoline before starting the test, and measuring the amount of fuel required to completely fill the tank after completion of the test.

TEST 1

TESTED AUTOMOBILE:

NISSAN SUNNY 1600 SUPER SALOON, AUTOMATIC TRANSMISSION, 1991-MODEL, E-EB13 TYPE, GA16 MOTOR, Total Cubic Capacity 1596 CC

RUNNING CONDITIONS:

CITY AREA: In and around Ichikawa City, Chiba Prefecture, Japan

EXPRESSWAY: Ichikawa Interchange to→Higashi-Kanto Expressway→around the Narita Airport Terminal→Higashi-Kanto Expressway→Ichikawa Interchange (Average Speed: 95 km/h)

MEASURING PLACE: Mazda Auto Ichikawa Business Office

MEASURING INSTRUMENT:

ZFE-1 multiple instrument, made by Fuji Electric Co., Ltd.

Tables 1 and 2 show the result of measurement of fuel consumption ratios and the result of measurement of exhaust gases, respectively, for a first test automobile.

TABLE 1

| | RUNNING CON-DITIONS | TOTAL DISTANCE OF RUN (km) | CON-SUMED GASO-LINE (liter) | DISTANCE TRAVELED PER LITER OF GASOLINE (km/l.) |
|---|---|---|---|---|
| WITHOUT THE INVENTION | CITY | 238.6 | 33.0 | 7.230 |
| | CITY | 268.8 | 36.5 | 7.364 |
| | CITY | 256.8 | 36.0 | 7.133 |
| | EXP. WAY | 111.5 | 6.8 | 16.397 |
| WITH THE INVENTION | CITY | 420.4 | 37.5 | 11.210 |
| | CITY | 345.6 | 28.4 | 12.169 |
| | CITY | 130.0 | 10.3 | 12.621 |
| | EXP. WAY | 111.5 | 3.5 | 31.857 |

TABLE 2

| | TIME (24 hr. clock) | $CO_2$ (ppm) | $NO_x$ (ppm) |
|---|---|---|---|
| WITHOUT THE INVENTION (10) | 11:00~11:30 | 0.08~0.09 | 0.00~0.00 |
| | 12:30~13:00 | 0.08~0.09 | 0.00~0.00 |
| WITH THE INVENTION (10) | 15:00~15:30 | 0.02~0.02 | 0.00~0.00 |
| | 11:00~11:20 | 0.02~0.02 | 0.00~0.00 |

TEST 2

TESTED AUTOMOBILE:

BMW 535i, Automatic Transmission, 1991-Model, E-535 TYPE, Total Cubic Capacity 3430 CC

RUNNING CONDITIONS:

CITY AREA: In and around Ichikawa City, Chiba Prefecture, Japan

MEASURING PLACE: Mazda Auto Ichikawa Business Office

MEASURING INSTRUMENT:

ZFE-1 multiple instrument, made by Fuji Electric Co., Ltd.

Tables 3 and 4 show the result of measurement of fuel consumption ratios and the result of measurement of exhaust gases, respectively, for a second test automobile.

TABLE 3

| | RUN-NING CON-DITIONS | TOTAL DISTANCE OF RUN (km) | CON-SUMED GASO-LINE (liter) | DISTANCE TRAVELED PER LITER OF GASOLINE (km/l.) |
|---|---|---|---|---|
| WITHOUT THE INVENTION | CITY | 120.0 | 27.5 | 4.363 |
| WITH THE INVENTION | CITY | 120.0 | 15.5 | 7.741 |

TABLE 4

| | TIME (24 hr. clock) | $CO_2$ (ppm) | $NO_x$ (ppm) |
|---|---|---|---|
| WITHOUT THE INVENTION | 13:00~13:30 | 0.12~0.13 | 0.00~0.00 |
| WITH THE INVENTION | 15:00~15:20 | 0.03~0.04 | 0.00~0.00 |

Tables 1 and 3 illustrate that the average fuel consumption rate, measured by the distance traveled per liter of gasoline, is 7.242 km/l. and 4.363 km/l. for the automobile having an engine without the fuel flow restriction device 10 and spark plug 31 of the present invention. The average fuel consumption rate is 12.0 km/l. and 7.741 km/l. for the automobile with the engine fitted with the fuel flow restriction device 10 and spark plug 31 of the present invention. Accordingly, the automobile with the present invention installed is approximately 165.7% to 177.4% more fuel efficient than a conventional automobile without the present invention.

Tables 2 and 4 illustrate the emission of carbon dioxide ($CO_2$) is approximately 0.08 ppm to 0.09 ppm, and 0.12 ppm to 0.13 ppm, respectively, when the automobile's engine does not include the fuel flow restriction device 10 and spark plug 31 of the present invention, while the emission of $C)_2$ gas is approximately 0.02 ppm and 0.03 ppm in to 0.04 ppm, respectively, when the engine is fitted with the present invention. Therefore, the emission of $CO_2$ from the automobile fitted with the present invention is 23.5% and 28% of the emission of $CO_2$ from the automobile without the invention.

Figure 9:
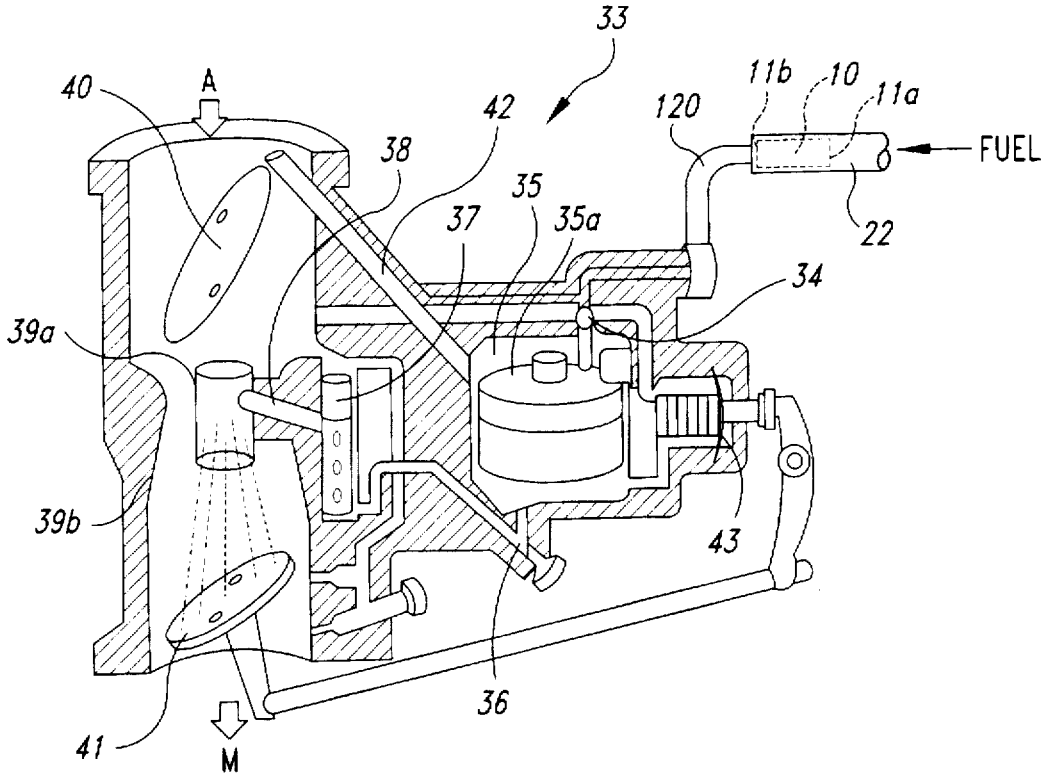
FIG. 9 is a schematic view showing a fuel flow restricting device of FIG. 5 in a fuel hose adjacent to a carburetor of an internal combustion engine.

The present invention also generates similar improvements in fuel efficiency and emission reductions for an automobile engine having a carburetor rather than a fuel injector system. As best seen in FIG. 9, when using a carburetor 33 as a fuel supply means, the fuel flow restricting device 10 is positioned in the fuel hose 22 adjacent to an inlet 120 of the carburetor 33. The fuel flow restricting device 10 is positioned with the fuel discharge end **11*b* facing the inlet 120, and the receiving end 11*a* facing away from the fuel tube. Accordingly, the fuel flow restricting device 10 is disposed on the up-stream or upper-flow side of the carburetor 33**.

The carburetor 33 illustrated in FIG. 9 is a conventional fixed-venturi carburetor having a needle valve 34, a float chamber 35, a float **35*a*, a main jet 36, an air bleeder 37, a main nozzle 38, a small venturi 39*a*, a large venturi 39*b*, a choke valve 40, a throttle valve 41, an air vent 42, and an accelerating pump 43** of conventional design. The reference characters A and M designate air and air-fuel mixture, respectively.

Gasoline moving through the fuel hose 22 is passed through the fuel flow restricting device 10, thereby reducing the fuel flow, and the gasoline is sprayed into the inlet 120 of the carburetor 33. The spray of fuel passes through the carburetor 33 and is discharged from the main nozzle 38. The main nozzle 38 further atomizes the fuel to provide a very finely atomized fuel that is mixed with air to provide an air-to-fuel ratio in the range of approximately 90:1 to 240:1.

Similar to the embodiment discussed above with the fuel injector system, the fuel is supplied from the fuel tank (not shown) to the carburetor 33 through a fuel pump, a fuel filter, and the fuel flow restricting device 10. The fuel flow restricting device 10 sprays the liquid fuel into fine particles and sends them to the carburetor 33. In the carburetor 33, the fine particles are further broken up into much finer particles, almost gaseous matter, by the main nozzle 38 and are discharged from the main nozzle into the large venturi **39*b***.

The finely atomized fuel discharged from the main nozzle 38 is mixed with oxygen of the air A and the resulting air-fuel mixture M is passed by the throttle valve 41 and into the combustion chamber (not shown). In the embodiment with the carburetor 33, the internal combustion engine includes spark plugs 31 that produce the enlarged sparks as discussed above, and each spark plug is positioned partially in a respective combustion chamber to create an enlarged spark in the combustion chamber. The air-fuel mixture M in the combustion chamber is ignited by the enlarged spark from the spark plug 31, and the air-fuel mixture is explosively and efficiently burned so as to produce, using less fuel, approximately the same amount of power as a conventional engine without the present invention.

The fuel flow restricting device 10 and the spark plug 31 are adapted to be installed in an internal combustion engine 5 having a carburetor 33 in a retrofit procedure or during the engine manufacturing process. The fuel flow restricting device 10 is positioned as close as possible to the inlet 120 of the carburetor 33, and preferably immediately adjacent to the inlet, for best performance. Accordingly, an existing internal combustion engine can easily be fitted with the fuel flow restricting device 10, and the conventional spark plugs replaced with the spark plugs 31 of the present invention to provide substantially increased fuel efficiency and reduced engine emissions.

In an alternate embodiment, the carburetor 33 is constructed to substantially reduce the fuel flow at the main nozzle 38 by providing a very small opening in the main nozzle, so as to produce the very finely atomized fuel that is mixed with air in the 90:1 to 240:1 air-to-fuel ratio mixture before being passed into the combustion chamber.

Figure 10A:
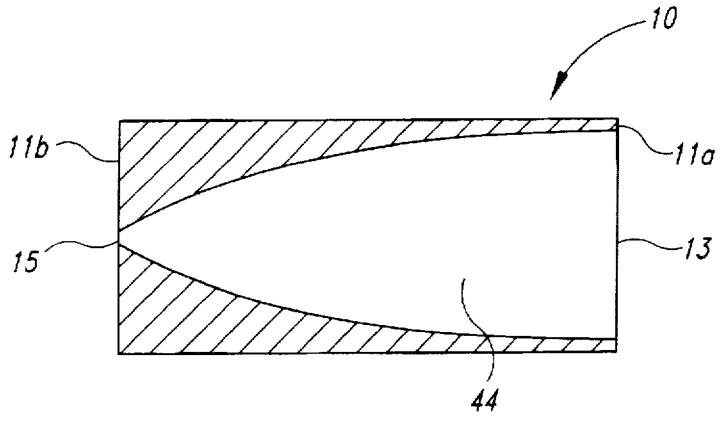
FIGS. 10*a* and 10*b* are cross-sectional views showing alternate embodiments of the fuel flow restricting device.
Figure 10B:
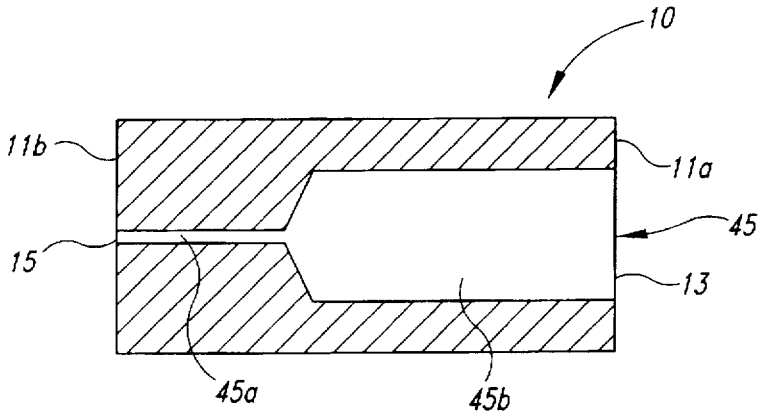

As best seen in FIG. 10*a*, an alternate embodiment of the fuel flow restricting device 10 has a bullet-shaped passage 44 with large and small openings 13, 15, respectively, rather than the funnel shaped passage 12 of FIGS. 2*a* and 2*b*. In another alternate embodiment illustrated in FIG. 10*b*, the fuel flow restricting device 10 has a fuel passage 45 constructed with two coaxially aligned tubular passages 45*a* and 45*b* having different diameters. The passage 45*b* forms the large opening 13 at the fuel receiving end 11*a*, and the passage 45*a* forms the small opening 15 at the fuel discharging end 11*b*. The small diameter passage 45*a* has a diameter of approximately 0.5 mm to 1.5 mm. The shape or size of the fuel flow restricting device 10 is not limited to the above embodiments.

Accordingly, the present invention results in a high fuel combustion efficiency, and a substantially increased fuel efficiency. In addition, the internal combustion engine runs cooler, and the emissions of undesirable gases are substantially reduced as compared to a conventional engine. As a result, components on internal combustion engines for reducing emissions, such as catalytic converters, can be eliminated. Furthermore, because the internal combustion engine with the fuel supplying assembly of the present invention is not contaminated with carbon or the like due to the virtually 100% fuel combustion, the engine's life is lengthened. Further, the contamination to an exhaust muffler is also lessened.

Numerous modifications and variations of the invention disclosed herein will occur to those skilled in the art in view of this disclosure. Therefore, it is to be understood that modifications, variations, and equivalents thereof may be practiced while remaining within the spirit and scope of the invention as defined by the following claims.

What is claimed is:

1. A spark plug for use with an internal combustion engine for an automotive vehicle, comprising:

a body;

an insulator connected to the body;

a center electrode connected to the insulator out of electrical contact with the body, the center electrode having an end portion with a shaft and an end member attached to the shaft, the end member having a cross-sectional area in the range from approximately 15.896 $mm^2$ to 44.156 $mm^2$; and a ground electrode connected to the body and spaced apart from the end member of the center electrode to define a spark plug gap therebetween.

* * * * *